United States Patent [19]

Smith

[11] 4,100,035

[45] Jul. 11, 1978

[54] APPARATUS FOR QUENCHING DELAYED COKE

[75] Inventor: George E. Smith, Stillwater, Okla.

[73] Assignee: Continental Oil Company, Ponca City, Okla.

[21] Appl. No.: 769,643

[22] Filed: Feb. 17, 1977

Related U.S. Application Data

[62] Division of Ser. No. 619,279, Oct. 3, 1975, abandoned.

[51] Int. Cl.[2] ..... C10B 39/06

[52] U.S. Cl. ..... 202/227; 208/131

[58] Field of Search ..... 208/48 R, 48 Q, 131; 134/39, 167 R; 201/2, 39; 202/227, 81, 95, 105

[56] References Cited

U.S. PATENT DOCUMENTS

| | | | |
|---|---|---|---|
| 469,867 | 3/1892 | Osbourn | 202/227 |
| 1,735,462 | 11/1959 | Johnson | 208/131 |
| 3,745,110 | 7/1973 | Allred | 208/131 |
| 3,836,434 | 9/1974 | Novy | 134/39 |
| 3,843,461 | 10/1974 | Allen | 202/227 |
| 3,892,633 | 7/1975 | Oleszko et al. | 208/131 |
| 3,936,358 | 2/1976 | Little | 208/131 |
| 3,988,211 | 10/1976 | Lewandowski et al. | 202/227 |

*Primary Examiner*—Morris O. Wolk
*Assistant Examiner*—Arnold Turk
*Attorney, Agent, or Firm*—Richard W. Collins

[57] ABSTRACT

Delayed petroleum coke is produced by conventional processing, including steaming of the coke in the drum to remove volatile material. After the steaming operation, the coke is quenched by injecting water onto the top of the steamed coke and passing the quench water downwardly through the coke, whereby the coke bed acts as a filter to trap fines which would pass overhead when the normal method of quenching by injecting quench water upwardly is used. Apparatus including retractable spray nozzles extending into the coke drum from the top is described.

2 Claims, 3 Drawing Figures

APPARATUS FOR QUENCHING DELAYED COKE

This is a division, of application Ser. No. 619,279, filed Oct. 3, 1975 now abandoned.

BACKGROUND OF THE INVENTION

1. Field of the Invention

This invention relates to the manufacture of delayed petroleum coke, and more particularly to an improved method of quenching a drum of coke. The method is applicable to a delayed coking process wherein a coke feedstock is heated in a furnace to coking temperature, introduced into a coking drum, and maintained therein at coking conditions until delayed petroleum coke is formed. After completion of the coking reaction, it is conventional to inject steam into the coking drum to vaporize volatile hydrocarbons remaining in the drum. These volatile hydrocarbons normally are passed to a fractionator for recovery or recycle. Following removal of volatile hydrocarbons from the coke in the coking drum, injection of steam is normally continued, with discharge of same to a blowdown tank. Following completion of the steaming step, it is conventional to inject quench water into the lower part of the coking chamber, whereby the delayed coke is cooled to below ignition temperature prior to removal of the coke from the coking drum. The quench water is converted to steam as it passes through the coke in the coking drum, and the steam tends to carry over an appreciable amount of fines into the blowdown tank to which it is discharged. This carry-over of fines to the blowdown tank leads to operating difficulties and in some cases contributes to environmental problems. There has been a long standing need for a coking process which does not result in fines carry-over to the blowdown tank.

2. Description of the Prior Art

The delayed coking process has been widely utilized for many years as a method of recovering a useful product from heavy residual oils and other similar streams from a refinery process. The production of regular coke, useful primarily as a fuel, is described in many literature and patent references, of which U.S. Pat. No. 2,316,931 is exemplary. As described therein, coking feedstock is passed through a furnace and introduced into a coking chamber where delayed coke is formed. After the coking chamber is filled with coke, steam is introduced into the bottom of the coking chamber to remove volatile hydrocarbons therefrom followed by a pressure reduction or blowdown step wherein further light material is removed from the coking chamber. After completion of the steaming step, water is introduced into the bottom of the coking drum to effect cooling of the coke to below its ignition temperature so that the coke drum may be opened to the atmosphere for removal of the coke. Prior to this invention, the industry has universally followed the practice of introducing quench water into the bottom of the coking drum, with the resultant problems referred to above regarding carry-over of fines to a sump or blowdown tank.

SUMMARY OF THE INVENTION

According to the present invention, the coking apparatus and process are modified so that the quench water is introduced into the top of the coking drum and passed downwardly through the bed of coke therein for discharge through the bottom of the coking drum. As a result of this modification, the fines material normally carried over to the blowdown tank by steam formed by the quench water passing upwardly through the hot coke, which fines normally are predominantly in the upper portion of the coke bed, are trapped in the coke bed as the quench water and resultant steam passes downwardly therethrough, such that the fines do not accumulate in the blowdown tank. A plurality of spray nozzles are disposed about the top of the coking drum for introduction of quench water onto the top of the coke bed, and preferably the nozzles are retractable into protective housings to prevent coke formation on the nozzles during the coke formation portion of the process.

DESCRIPTION OF THE PREFERRED EMBODIMENTS

The process according to the invention involves carrying out a delayed coking process for the formation of either regular or premium coke in a conventional manner up through the step of introducing steam to the coke drum to remove volatile hydrocarbons therefrom. Following completion of this steaming step, the process according to the invention, and contrary to conventional practice, involves introducing quench water through the top of the coke drum whereby the quench water passes downwardly through the coke bed and is discharged from the bottom of the coking drum. It will be appreciated that the coke, after the steaming step, is still at a temperature of 350° C or more so that the quench water is converted to steam at least during the initial portion of the quenching step. The quench water and resulting steam discharged from the bottom of the coking drum are passed to a blowdown tank or pond for recovery and re-use.

Figure 1:
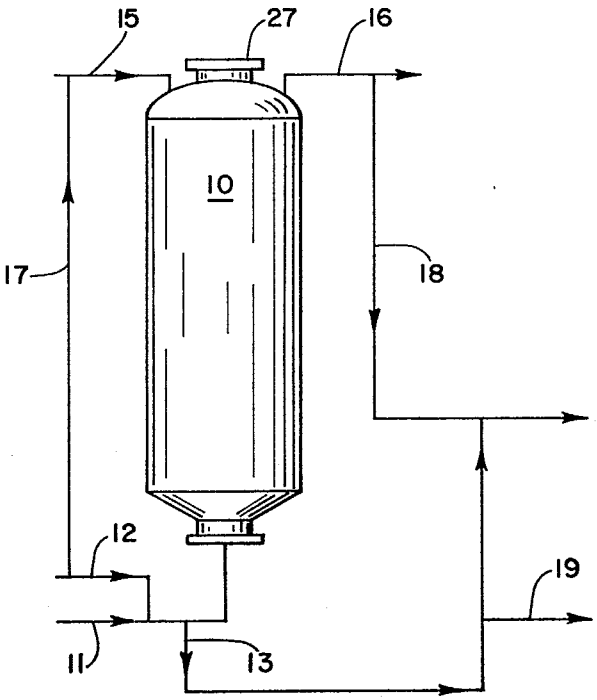
FIG. 1 is a schematic flow sheet illustrating the process of the invention.

The process of the invention is more easily understood by reference to FIG. 1, which shows a coking drum 10 including a feedstock inlet line 11 and a steam inlet line 12 for introduction of hydrocarbon feedstock or steam into the bottom of the coking drum 10 according to conventional practice. An additional quench water outlet line 13 is provided for removal of vaporized quench water from the bottom of the coking drum 10. A quench water inlet line 15 is provided for introduction of quench water into the top of the coking drum 10, and a vapor outlet line 16 is provided for removal of volatile hydrocarbons and associated steam to either a fractionator or a blowdown tank. The various lines in FIG. 1 are illustrated schematically, and it will be appreciated that appropriate valving must be provided for carrying out the process. The only additions to a conventional delayed coking installation required for this invention are the quench water inlet 15 at the top of the coking drum and the quench water outlet 13 at the bottom of the coking drum. In order to provide maximum flexibility to the process, a steam line 17 is provided whereby steam can be injected through quench water inlet 15 into the top of the drum in order that a portion of the steaming step may be conducted by passing steam downwardly through the coke bed if desired. A line 18 extending from vapor outlet line 16 to the blowdown tank is also provided, as is line 19 extending from quench water outlet 13 to the fractionator.

According to one preferred embodiment of the process of the invention, a delayed coking process is carried out in a conventional manner up through the initial steaming of the coke in the coking drum. That is, medium pressure steam is injected into the bottom of coking drum 10 and passed upwardly through the coke bed, removing volatile hydrocarbon material from the coke bed for passage to a fractionator. After this initial steaming operation, which normally would take about two hours, at which time the coke bed would be at a temperature of about 370° C, the steam inlet is switched to line 15, and vapor outlet line 16 is closed. Quench water outlet line 13 is opened and steam passing downwardly through the coke bed is exhausted to a blowdown tank, or to a fractionator if sufficient volatile hydrocarbon material is still present in the discharge. Upon completion of the steaming operation, quench water, preferably from the blowdown tank, is introduced through the top of the coking drum 10 and passes downwardly through the coke bed to complete the cooling of the coke to a temperature of about 100° C or less. The initial quench water will be vaporized and discharged as steam, and at the end of the quench step the coking drum is preferably filled with water, followed by draining of water to the extent possible prior to removal of the coke from the coking drum in a conventional manner.

According to a variation of the above-described embodiment, the entire steaming operation may be conducted by passing all of the steam upwardly through the coke bed, with only the quench water being introduced through the top of the coking drum. However, by introducing a portion of the steam through the top of the coking drum, in some cases the amount of froth and fines passing overhead through vapor outlet line 16 is minimized, and the maximum amount of froth and fines is directed downwardly through the bed of coke which acts as a filter such that the fines do not get into the blowdown system to the extent that they would using the conventional steaming process.

Figure 3:
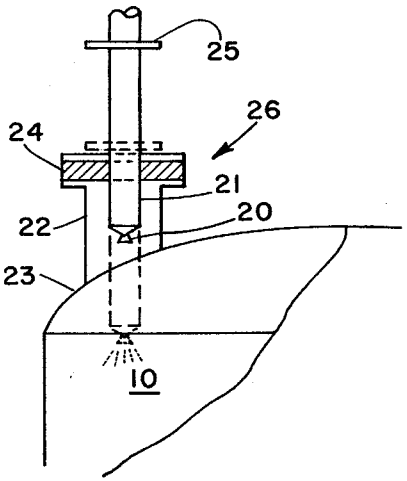
FIG. 3 is a cross section illustrating the details of a retractable nozzle and protective housing on the top of the coke drum.

A preferred retractable spray nozzle assembly 26 for injecting quench water and/or steam through the top of the coke drum is illustrated in FIG. 3, and includes a nozzle 20 attached to the end of line 21. The line 21 is shown in a retracted position in full lines with the nozzle 20 positioned within protective housing 22 attached to and extending from the top 23 of the coking drum, and the line 21 and nozzle 20 are shown in broken lines in the extended or operative position. Nozzle line 21 extends through packing material 24 at the top of protective housing 22, and a stop member 25 is provided on nozzle line 21 to limit the downward travel of nozzle 20 to the position shown by broken lines, which is the operative position for the nozzle. The nozzle line 21 may be raised and lowered through packing material 24 manually, or by any suitable means.

Figure 2:
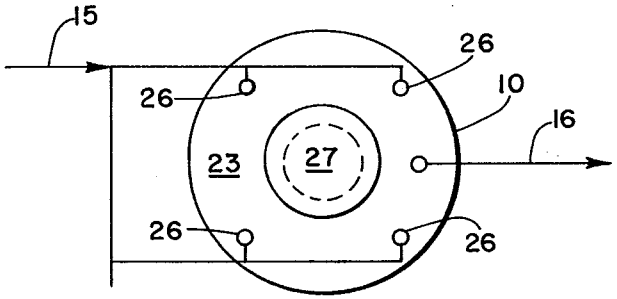
FIG. 2 is a top plan view of a coking drum having a plurality of nozzles uniformly distributed thereon.

FIG. 2 illustrates a preferred arrangement wherein four nozzle assemblies 26 are distributed about the top 23 of drum 10. This allows the quench water to be distributed more or less uniformly over the bed of coke within coking drum 10 to minimize channelling and to avoid hot spots in the quenched coke bed. A cap 27 covers the top center portion of coker drum 1 and is used for access to the interior of the drum for the coke removal operation.

A preferred embodiment of the process, utilizing the preferred apparatus as illustrated in FIGS. 2 and 3, will now be described. At the end of the coke forming step of a conventional coking process, steam is injected into the bottom of coking drum 10 through steam inlet 12, and vapor outlet line 16 is utilized to remove volatile materials and steam, as is conventional. After about 1 or 2 hours of steaming, steam inlet 12 is closed off, nozzle assemblies 26 are lowered into the spraying position wherein spray nozzles 20 are positioned within coking drum 10 below the top 23 thereof. Quench water is then injected through quench water inlet 15, and quench water outlet 13 is opened for removal of the steam formed by contact of the quench water with the hot coke. The steam from the quench water outlet may be passed to a fractionater if sufficient volatile hydrocarbon material is present in the stream, or it can be passed to a blowdown system if the amount of volatile hydrocarbon material is low. The overhead vapor outlet is of course closed during this stage of the process. A pressure relief valve (not shown) is preferably located near the top of coking drum 10 as a safety precaution. Toward the end of the quenching step, when the coke has been cooled to approximately 100° C, the coking drum 10 is filled with quench water, allowed to set for a few minutes, and then drained to remove excess from the coke. The nozzle lines 21 are then raised back up to the protective housings 22 and retained therein during the next coking cycle to prevent formation of coke on the nozzles 20.

The top portion of a coke bed in a coking drum normally is a frothy material containing a large amount of fines. When the quench water is injected into the bottom of the drum, as is conventional, a large amount of this frothy fines-containing material goes out overhead to the blowdown system with resulting handling and environmental problems. By injecting quench water through the top of the coking drum, as provided for by this invention, this frothy fines-containing material is directed downwardly through the coke bed, which serves as a filter to retain the fines material rather than allowing them to be directed to the blowdown system.

The essential feature of the process of this invention is that quench water is injected into the top of a coking drum following the steaming step, with removal of the quench water through the bottom of the coking drum. This step is made possible by utilizing retractable spray nozzles positioned about the top of the coking drum as previously described. The retractable feature of the nozzle assemblies eliminates the problem of coke formation on the nozzles, which would otherwise interfere with the spraying of quench water into the drum.

Numerous variations and modifications of the process and apparatus described above will be apparent to those skilled in the art, and the foregoing description of the preferred embodiments should be considered as illustrative, rather than limiting, of the invention.

I claim:

1. In a delayed coking drum comprising an elongated vertically oriented coking drum having feedstock inlet means at the bottom thereof, vapor outlet means at the top thereof, steam inlet means at the bottom thereof, and coke outlet means at the bottom thereof, the improvement comprising:

retractable nozzle means extending downwardly from the top of the coking drum for introducing quench water onto the top of a bed of delayed coke therein;

protective housing means for the retractable nozzle means on the top of the coking drum whereby the nozzle means may be stored therein out of the main body of the coking drum when not in use;

means limiting the downward movement of the nozzle means whereby the nozzle means do not extend into a bed of delayed coke in the coking drum; and steam outlet means at the bottom of the coking drum for removal of steam formed by contact of quench water with hot coke.

2. Apparatus according to claim 1 wherein the retractable nozzle means is a plurality of retractable nozzles extending through the top of the coking drum and distributed uniformly thereabout.

* * * * *